US012098612B2

(12) United States Patent
Cochran et al.

(10) Patent No.: US 12,098,612 B2
(45) Date of Patent: Sep. 24, 2024

(54) INFLATABLE PACKER SYSTEM FOR SUBMERSIBLE WELL PUMP

(71) Applicant: Schlumberger Technology Corporation, Sugar Land, TX (US)

(72) Inventors: Jamie Cochran, Inverurie (GB); Richard McCann, Aberdeen (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/253,980

(22) PCT Filed: Nov. 22, 2021

(86) PCT No.: PCT/EP2021/082560
§ 371 (c)(1),
(2) Date: May 23, 2023

(87) PCT Pub. No.: WO2022/106704
PCT Pub. Date: May 27, 2022

(65) Prior Publication Data

US 2023/0407723 A1 Dec. 21, 2023

Related U.S. Application Data

(60) Provisional application No. 63/117,049, filed on Nov. 23, 2020.

(51) Int. Cl.
*E21B 33/127* (2006.01)

(52) U.S. Cl.
CPC ..... *E21B 33/1275* (2013.01)

(58) Field of Classification Search
CPC ..... E21B 33/1275
See application file for complete search history.

(56) References Cited

U.S. PATENT DOCUMENTS 3,087,549 A * 4/1963 Brunton ..... E21B 29/02 166/100
3,876,000 A * 4/1975 Nutter ..... E21B 49/088 166/147

(Continued)

FOREIGN PATENT DOCUMENTS

WO 2019122835 A1 6/2019

OTHER PUBLICATIONS

Wrighton, Christopher et al., "A Novel Technique to Revive Killed Wells Badk into Production", Paper presented at the International Petroleum Technology Conference held in Dhahran, Saudi Arabia, 2020, 16 pages.

(Continued)

*Primary Examiner* — Taras P Bemko
(74) *Attorney, Agent, or Firm* — Jeffrey D. Frantz

(57) ABSTRACT

A well pump system includes a fluid pump having an inlet and a discharge. The inlet and discharge are separated longitudinally by an inflatable annular seal. An inflation line extends between the discharge and an inflation inlet of the inflatable annular seal. A pressure relief is operable to direct flow from the discharge to the inflation line. The pressure relief is operable to open the discharge to flow to surface in the well when a predetermined fluid pressure is reached. The system includes means for opening the inflation line to release pressure in the inflatable annular seal when a selected tension is applied to the well pump system.

16 Claims, 6 Drawing Sheets

(56) References Cited

U.S. PATENT DOCUMENTS

| | | | | |
|---|---|---|---|---|
| 5,404,946 | A * | 4/1995 | Hess | E21B 33/1275 166/325 |
| 10,032,610 | B2 | 7/2018 | Krassnitzer | |
| 10,648,273 | B2 * | 5/2020 | Krieg | E21B 33/1275 |
| 11,851,974 | B1 * | 12/2023 | Ejim | E21B 34/14 |
| 2014/0166277 | A1 * | 6/2014 | Ade-Fosudo | E21B 33/1275 166/66.4 |

OTHER PUBLICATIONS

Search Report and Written Opinion of International Patent Application No. PCT/EP2021/082560 dated Mar. 7, 2022, 9 pages.
International Preliminary Report on Patentability of International Patent Application No. PCT/EP2021/082560 dated May 16, 2023.
Substantive Exam issued in Saudi Arabia Patent Applicaton No. 523440869 dated Feb. 4, 2024, 11 pages with English translation.

* cited by examiner

INFLATABLE PACKER SYSTEM FOR SUBMERSIBLE WELL PUMP

CROSS-REFERENCE TO RELATED APPLICATIONS

This application is the National Stage Entry of International Application No. PCT/EP2021/082560, filed Nov. 22, 2021, which claims the benefit of U.S. Provisional Application No. 63/117,049, filed Nov. 23, 2020.

BACKGROUND

This disclosure relates to the field of subsurface well pumps, such as electric submersible well pumps (ESPs). More particularly, the disclosure relates to annular seal systems (packers) used to set well pumps, including ESPs, in a well for fluid production, where the annular seal can be relaxed for ready removal of the ESP on an electrical cable.

U.S. Pat. No. 10,032,610 issued to Maclean et al. discloses a method for deploying an electric submersible pump (ESP) into a subsurface well using an electrical cable. It is known in the art to deploy ESPs with or assembled to an annular seal, e.g., a packer, to close an annular space between the ESP and a conduit in the well, so that fluid lifted by the ESP is constrained to move within the conduit to surface.

Inflatable packers are known in the art to be used in circumstances where it may be expected to remove the packer for well intervention. Using an inflatable packer with an ESP, where pump discharge is used to inflate the packer, may be limited by the fact that ESPs are frequently centrifugal pumps. Centrifugal pumps flow in the same direction irrespective of the rotation direction of the ESP, thus requiring some form of valve arrangement to direct flow for inflating and deflating the packer.

SUMMARY

One aspect of the present disclosure is a well pump system. A well pump system according to this aspect includes a fluid pump having an inlet and a discharge. The inlet and the discharge are fluidly separated by an inflatable annular seal. An inflation line extends between the discharge and an inflation inlet of the inflatable annular seal. A pressure relief is operable to direct flow from the discharge to the inflation line. The pressure relief is operable to open the discharge to flow to surface in the well when a predetermined fluid pressure is reached. The system includes means for opening the inflation line to release pressure in the inflatable annular seal when a selected tension is applied to the well pump system.

The fluid pump may comprise an electric submersible pump.

The means for opening may comprise an unloader sub having two components connected to each other longitudinally by at least one shear pin.

The inflation line may be operable to be withdrawn from a receptacle in the inflatable annular seal on relative movement of the well pump with respect to a deployment cable when the at least one shear pin is severed.

The well pump system may be deployable by an electrical cable.

The pressure relief may comprise a burst disk.

A method for deploying a well pump in a well conduit according to another aspect of this disclosure includes moving the well pump to a chosen depth in the well. The well pump is started to discharge fluid into an inflatable annular seal external to the well pump to inflate the annular seal. A pressure relief is opened to divert discharge of the pump to the well conduit on one side of the annular seal when the annular seal is inflated. The well pump is operated to move fluid from the well to surface. The well pump is stopped and tension is applied to the well pump to vent fluid trapped in the annular seal. The pump is lifted out of the well.

The extending the well pump may comprise extending an electrical cable into the well.

The applying tension may comprise retracting the electrical cable.

Venting trapped fluid may comprise breaking a shear pin to move a part of the well pump relative to the annular seal.

The lifting the well pump may comprise retracting the electrical cable.

Other aspects and possible advantages will be apparent from the description and claims that follow.

DETAILED DESCRIPTION

Figure 1A:
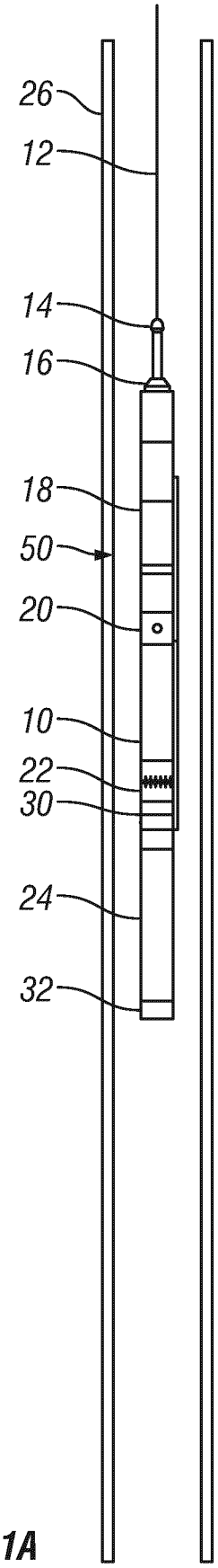
FIG. 1A and FIG. 1B show deployment of a pump according to the present disclosure.
Figure 1B:
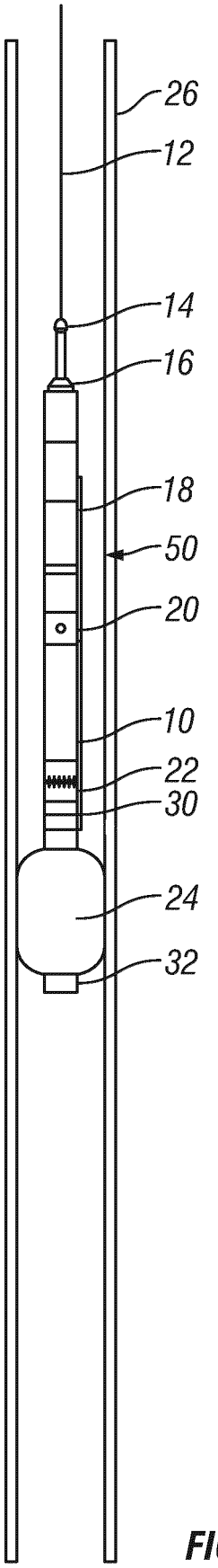

A general description of an inflatable packer and its use in deploying a well pump in a well tubular (e.g., casing or tubing) is as follows. The well pump may be assembled with an inflatable packer. The well pump and the inflatable packer may be deployed in a subsurface well tubular. Deployment may be on the end of an armored or tubing encapsulated electrical cable. The well pump may be an electrical submersible pump (ESP) such as a centrifugal pump. The well pump may be connected to the electrical cable through an adapter sub.

The well pump may have its fluid intake disposed on one longitudinal side of the inflatable packer, and its fluid discharge located on the other longitudinal side of the inflatable packer. The pump discharge may be directed through suitable ports in the adapter sub. The adapter sub may comprise a pressure relief, for example, a burst disk, operable at a predetermined pressure. The pressure relief may be in fluid communication with the pump discharge so as to redirect fluid discharge from the well pump through a check valve to a packer inflation line. The pressure relief may, when opened, provide a fluid flow path from the pump discharge through the casing or tubing, to the surface. Pump discharge prior to opening the pressure relief is therefore directed to inflate the packer; after the pressure relief is opened, pump discharge is directed toward surface, while the check valve hold inflation pressure in the inflatable packer.

When the well pump is disposed at a selected depth in the well, the well pump is started, and as a result of placement of the pressure relief, fluid flow (discharge) from the well pump is directed into the inflatable packer. The inflatable packer thus inflates and locks the well pump in the well. The inflated packer also closes the annular space between the well pump and the well tubing or casing. When the packer is fully inflated, continued fluid pumping increases fluid pressure because the annular space is closed. When the fluid pressure reaches the operating pressure of the pressure relief, the pressure relief opens. Fluid flow from the pump discharge may then be directed to the surface in the well casing or tubing. Fluid remains under pressure in the packer by action of the check valve.

When it is desired to remove the pump from the well, the pump may be stopped. The deployment cable may then be withdrawn, thereby applying upward force on the well pump, which is held in place in the well by the inflated packer. The adapter sub may be longitudinally extensible upon applying a predetermined amount of upward force on the well pump. The predetermined upward force may be pre-set by using a device such as a shear pin to hold slidably engaged sections of the adapter sub in relative longitudinal positions until the shear pin breaking force is exceeded. On breaking the shear pin or otherwise exceeding the predetermined upward force, segments of the adapter sub may be free to move relative to each other, thereby enabling the length of the adapter sub to increase. Fluid connection between the pump discharge and the packer, namely, an inflation line, may be severed by relative movement of the sections of the adapter sub. The inflation line may be arranged to sever between the inflatable packer and a check valve, or to be withdrawn from a suitable receptacle. In this way, fluid pressure in the inflatable packer may be released so that the packer will deflate. The well pump may then be withdrawn from the well by withdrawing the electrical cable.

FIG. 1A shows deployment of a well pump 50 in a well casing or tubing 26. "Well pump" as that term is used in this disclosure means a fluid pump 10 and associated components used to deploy the fluid pump 10, operate the fluid pump 10 and direct flow from the fluid pump 10 to where it is intended. The well pump 50 may be extended into the well casing or tubing 26, (hereinafter the "well" for convenience) by extending a deployment cable 12 until the well pump 50 is disposed at a selected depth in the well 26. Although deployment on an electrical cable is shown in FIG. 1A and subsequent figures, it is to be understood that other forms of conveyance may be used in accordance with the present disclosure to deploy the well pump 50 in the well 26, including without limitation, slickline, coiled tubing, and jointed tubing or pipe. The conveyance, e.g., the deployment cable 12, may be connected to a string of longitudinally assembled components that form the well pump 50. Such components may include, for example, at an uppermost end, a cable head 14 to make connection to the deployment cable 12. The cable head 14 may be connected to a crossover sub 16, in which electrical and mechanical connection may be made between the cable head 14 and a pump drive assembly 18. The pump drive assembly 18 may comprise (none shown separately) one or more electric motors, a gear set and a drive shaft to couple rotary motion from the motor and gear set to the fluid pump 10, e.g., a centrifugal pump. While a method according to the present disclosure may have particular applicability to use with centrifugal pumps for reasons explained in the Background section herein, it is to be understood that pump deployment and retrieval methods according to the present disclosure may be used with other types of pumps, such as progressive cavity pumps or vane pumps. A bypass/check valve assembly 22 may be coupled on one side to the intake side of the fluid pump 10. An unloader sub 30 may be coupled to the other side of the bypass/check valve assembly 22. An intake tube or sub 32 may be coupled to the unloader sub 30 and may extend through an inflatable packer 24.

During deployment of the well pump 50 in the well 26 such as by extending the deployment cable 12, the inflatable packer 24 is fully retracted (uninflated) to enable free longitudinal movement of the well pump 50 through the well 26. When the well pump 50 is located at a chosen depth in the well 26, and referring to FIG. 2, the fluid pump 10 may be started by applying electrical power and/or suitable control signals along the deployment cable 12. The fluid pump 10 begins movement of fluid through the intake tube 32, through the bypass/check valve assembly 22, into the fluid pump 10 and then to the discharge side of the fluid pump 10. Fluid discharge from the fluid pump 10 is stopped from continued upward movement in the well 26 by a pressure relief, e.g., a burst disk disposed in a discharge sub 20 connected to the discharge side of the fluid pump 10. The discharge sub 20 will be explained in more detail below; a fluid connection within or on the discharge sub 20 may extend to the bypass/check valve assembly 22 such that fluid discharge from the fluid pump 10, when it is stopped by the pressure relief in the discharge sub 20, is directed to the interior of the inflatable packer 24, thereby inflating the inflatable packer 24. The fluid connection (not shown separately) may be a fluid line extending from the discharge sub 20 to the inflatable packer 24 along the exterior of the well pump 50, or may be formed in, along or through the walls of some of the above described components.

Figure 2A:
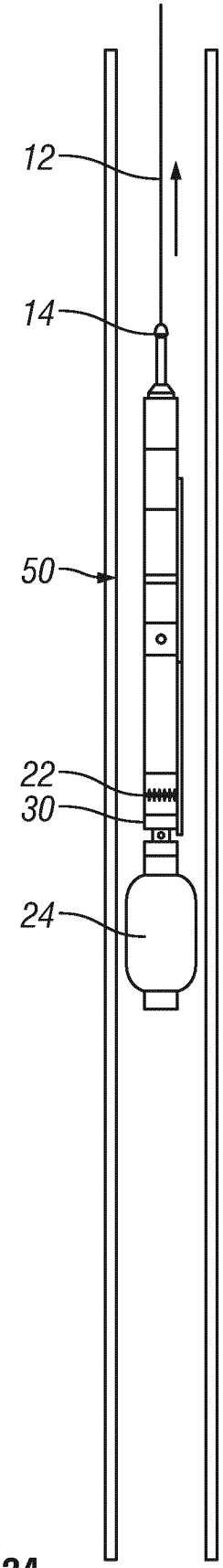
FIG. 2A and FIG. 2B show retrieval of a pump according to the present disclosure.
Figure 2B:
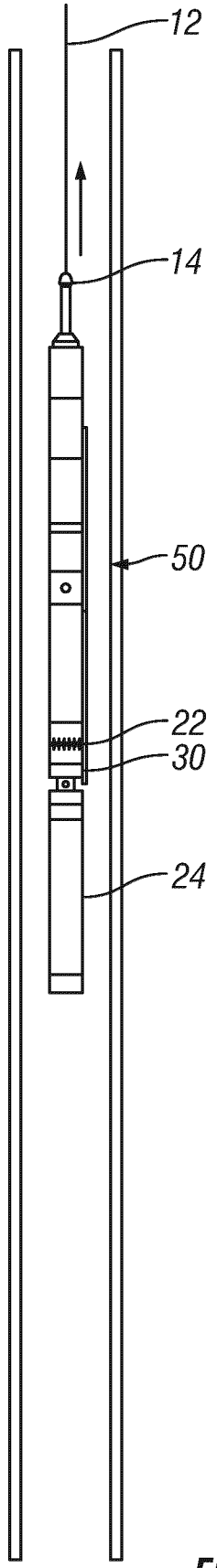
Figure 3:
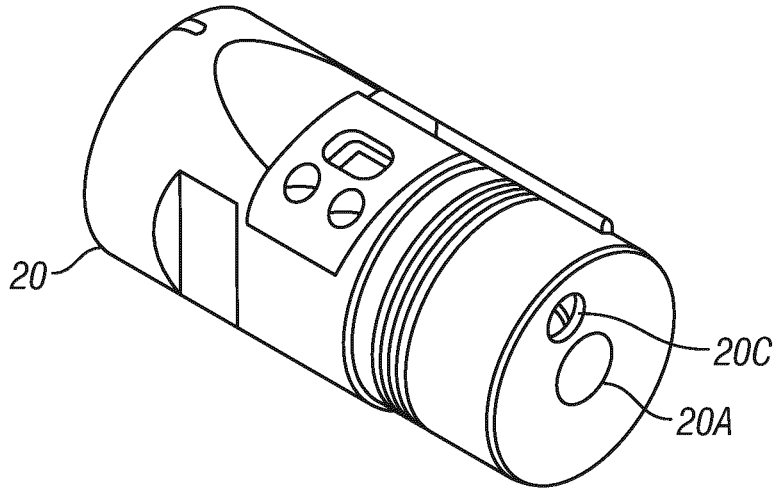
FIG. 3 shows an oblique view of a discharge sub for the pump of FIGS. 1A through 2B.
Figure 4:
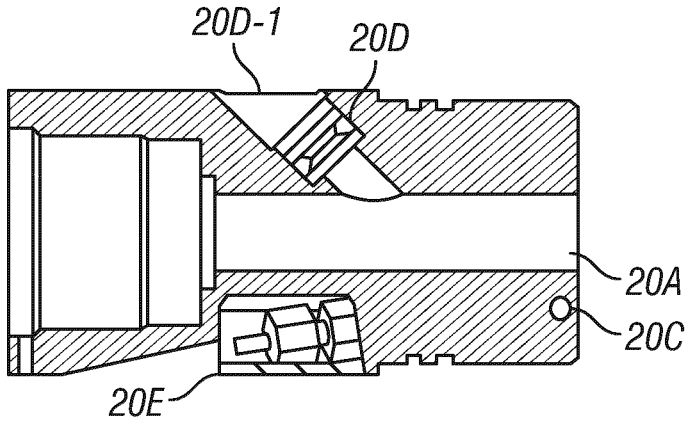
FIG. 4 shows a cross section view of the discharge sub of FIG. 3 showing placement of a pressure relief (e.g., a burst disk).

Once the inflatable packer 24 is fully inflated, as shown in FIG. 2, further operation of the fluid pump 10 will increase pressure in the discharge sub 20 until it reaches the operating pressure of the pressure relief (e.g., burst disk, see FIGS. 3 and 4). When the pressure relief (FIGS. 3 and 4) opens, fluid flow is then free to travel upwardly in the well 26 to surface. Pressure in the inflatable packer 24 is retained therein by a check valve (see FIG. 3), which may be disposed, for example, in the bypass/check valve assembly 22 or the discharge sub 20, such that the inflatable packer 24 remains inflated irrespective of operation of the fluid pump 10 or the fluid pump 10 discharge pressure. The fluid pump 10 may be operated or remain in the well 26 idle as the well operator may require.

FIGS. 2A and 2B show retrieval of the well pump 50 from the well 26. The fluid pump 10 is stopped. Then the deployment_cable 12 (or other conveyance as explained with reference to FIG. 1A) may be partially withdrawn from the well 26 to apply upward force to the well pump 50. Upward force on the well pump 50 is transferred from the cable head 14, through the assembled components described above, to the unloader sub 30. The unloader sub 30 may be connected as shown to the inflatable packer 24, such that tension on the well pump 50 is ultimately applied to the well 26 by reason of the inflated packer 24. One or more devices set to release on application of a predetermined axial force, e.g., shear pins or screws (not shown in FIGS. 1A through 2B), hold components of the unloader sub 30 in relative longitudinal position up to the point of applying the predetermined axial force. Once the predetermined axial force is reached, the shear pin(s) break, and as a result relative movement of the unloader sub 30 components unseats an inflation line (explained further below) from a receptacle, allowing fluid pressure in the inflatable packer 24 to release into the well 26. The inflatable packer 24 thus deflates. As shown in FIG. 2B, after the inflatable packer 24 is deflated, the well pump 50 may be retrieved by withdrawing the deployment cable 12 (or other conveyance as explained above).

FIG. 3 shows an oblique view, and FIG. 4 shows a cross sectional view of an example of the discharge sub 20 that may be coupled to the discharge end of the fluid pump (10 in FIG. 1A). The discharge sub 20 may have features to enable connection, for example, threaded connections, to the discharge side of the fluid pump (10 in FIG. 1A). Fluid discharge from the fluid pump (10 in FIG. 1A) may enter the discharge sub 20 through an intake port 20A. A fluid outlet port 20D-1 may be in fluid communication with the interior of the well (26 in FIG. 1A) above the inflatable packer (24 in FIG. 1A) such that fluid leaving the fluid outlet port 20D-1 may move toward the surface. When the well pump (50 in FIG. 1A) is first deployed in a well, the fluid outlet port 20D-1 may be closed to fluid flow by a pressure relief 20D, which may be a valve set to open at a predetermined pressure or a burst disk. An inflation port 20E may be fluidly connected (explained below) to the interior of the inflatable packer (24 in FIG. 1A) such that prior to opening the pressure relief 20D, fluid flow from the fluid pump (10 in FIG. 1A) is directed to the inflatable packer (24 in FIG. 1A). A check valve 20C may be disposed in the discharge sub 20 such that when the fluid pump (10 in FIG. 1) is stopped and/or the pressure relief 20D opens, fluid pressure is retained in the inflatable packer (24 in FIG. 1A) until which time as further operation is performed to retrieve the well pump (50 in FIG. 1A).

Figure 5:
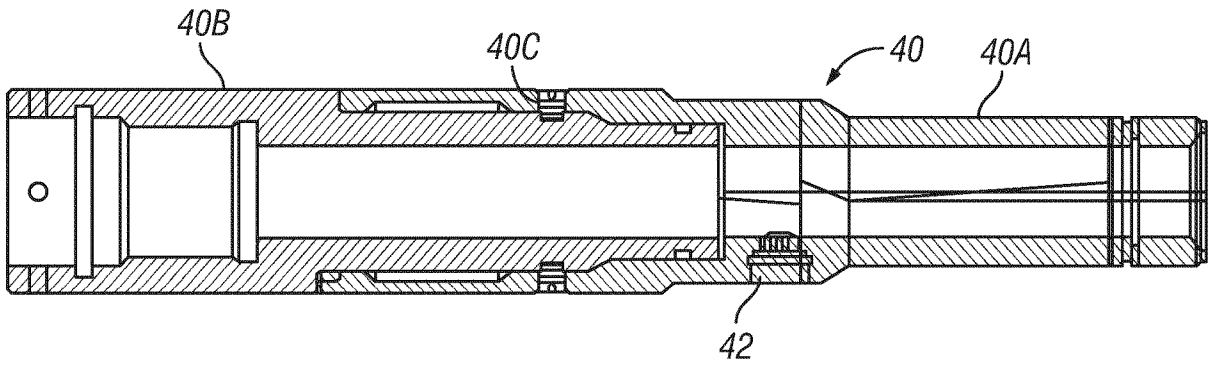
FIG. 5 shows cross sectional view of a disconnect sub that may be coupled above the inflatable packer.
Figure 6:
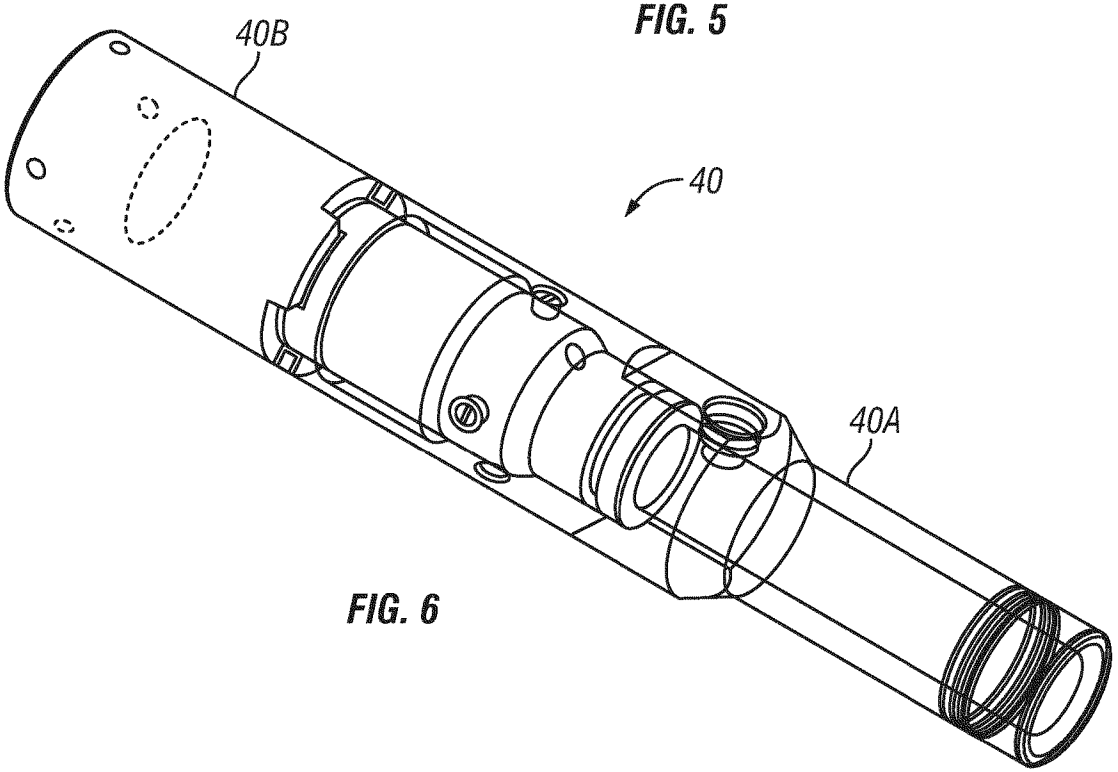
FIG. 6 shows an oblique view of the disconnect sub of FIG. 5.
Figure 7:
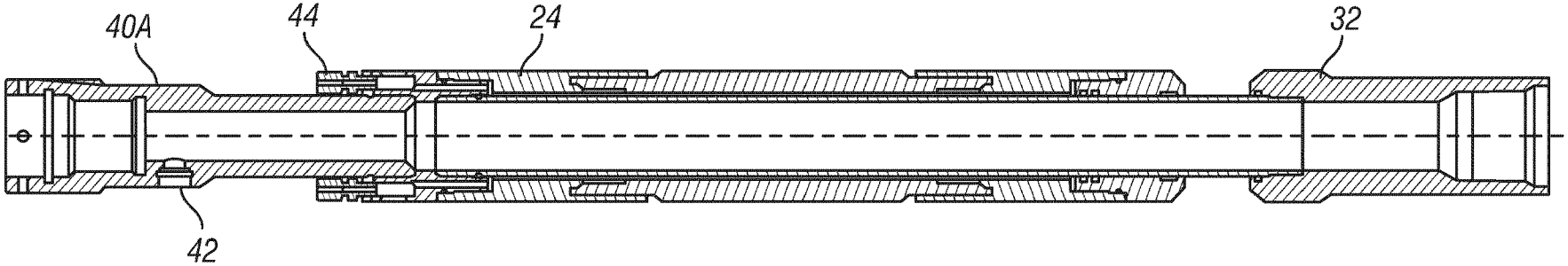
FIG. 7 shows a cross sectional view of one part of the disconnect sub coupled to one end of the inflatable packer.

FIG. 5 shows a cross sectional view, and FIG. 6 shows an oblique view of a disconnect sub 40. The disconnect sub 40 may comprise a first segment 40A, which may include features to enable coupling to the inflatable packer (see 24 in FIG. 1A), coupled to a second segment 40B using one or more shear pins, shear screws 40C or similar device that enables separation of the first segment 40A from the second segment 40B on application of a predetermined tensile force across the disconnect sub 40. The first component may include a pressure relief 42, such as a burst disk, to enable pumping fluid into the well if required, for example, to "kill" the well for certain intervention operations. The first segment 40A is shown coupled to the inflatable packer 24 in FIG. 7, wherein a disconnect 44 may be observed as a component from which the inflation line (not shown) may be withdrawn on either operation of the unloader sub (30 in FIG. 1A) or operation of the disconnect sub 40.

Figure 8:
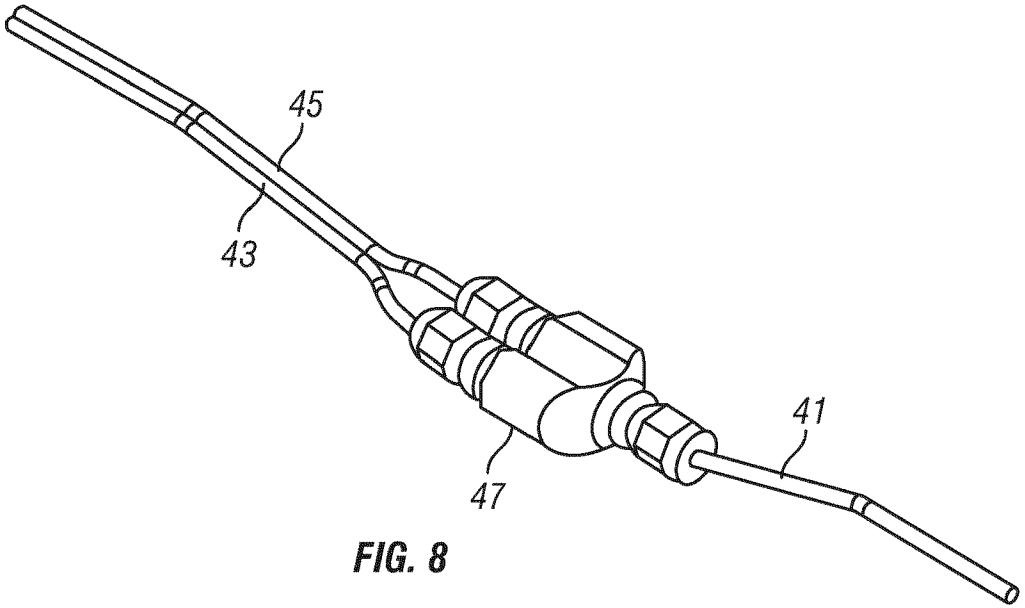
FIG. 8 shows an inflation line connected between the inflatable packer and the discharge sub.

FIG. 8 shows an example of fluid lines that may be used to connect fluid discharge from the check valve (20C in FIG. 4) to the inflatable packer (24 in FIG. 1A). An inlet line 45 may connect between a Y-block 47 having two fluid ports on one side and a single fluid port on the other side. A pressure gauge line 43 may connect between the Y-block 47 and a pressure gauge (not shown) located in a pump system monitoring sub (not shown) of a type that ordinarily is deployed as part of a submersible pump system. A discharge line 41 may connect the Y-block 47 to the disconnect (44 in FIG. 7). The fluid lines shown in FIG. 8 may be affixed to the exterior of the pump system between the discharge sub (20 in FIG. 1A) and the inflatable packer (24 in FIG. 1A), however such placement of the fluid lines is only one example of possible placement of such fluid lines. Other possible placement of fluid lines, as explained above, may be through conduits placed along, within or internal to the walls of the various subs and housings of the pump system.

Figure 9:
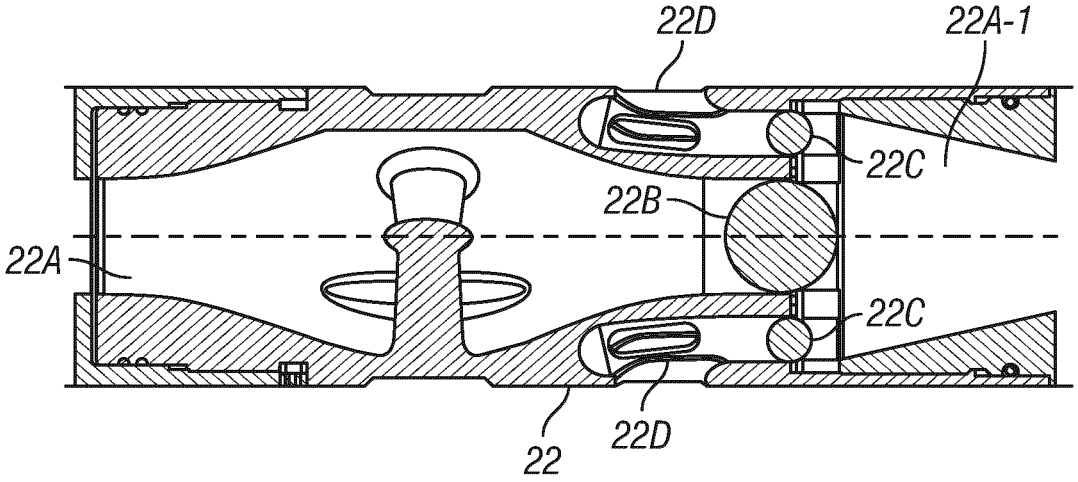
FIG. 9 shows a cross section view of the bypass/check valve sub of FIG. 1A in more detail.

FIG. 9 shows a cross sectional view of the bypass/check valve assembly 22. The bypass/check valve assembly 22 may include a main check valve 22B, such as a ball and seat check valve, to enable fluid flow from below the fluid pump (10 in FIG. 1A) intake, i.e., from inlet port 22A-1, to move upwardly into the fluid pump (10 in FIG. 1A), i.e., through outlet port 22A. One or more bypass check valves 22C, e.g., ball and seat check valves, may have one port in fluid communication with the inlet port 22A-1 and another port (bypass port) 22D in fluid communication with well fluid outside the pump system (50 in FIG. 1A). During pump operation, fluid pressure in the inlet port 22A-1 is lower than fluid pressure below the pump system (50 in FIG. 1A), whereby the main check valve 22B is lifted from its seat and allows flow from the inlet port 22A-1 to the outlet port 22A. At the same time, pressure in the well is greater than fluid pressure at the inlet port 22A-1 so that the bypass check valve(s) 22C are closed.

When the fluid pump (10 in FIG. 1A) is stopped, the main check valve 22B will close, such that reverse flow through the pump is substantially prevented.

In the event of a fluid influx to the well (26 in FIG. 1A) below the pump system (50 in FIG. 1A), pressure in the well below the bypass/check valve assembly will be greater than pressure at the outlet port 22A and the bypass port(s) 22D. In this way, all the check valves 22B, 22C will be open and fluid flow may pass through the outlet port 22A and the bypass ports 22D, thereby reducing the possibility of pump damage.

A well pump according to the present disclosure may be deployed and retrieved without the need for additional trips into or out of the well with additional tools or equipment, thus saving time and cost.

In light of the principles and examples described and illustrated herein, it will be recognized that the examples can be modified in arrangement and detail without departing from such principles. Any example referenced herein is freely combinable with any one or more of the other examples referenced herein, and any number of features of different embodiments are combinable with one another, unless indicated otherwise.

What is claimed is:

1. A well pump system comprising a fluid pump having an intake and a discharge, the intake and the discharge fluidly separated by an inflatable annular seal;

an inflation line extending between the discharge and an inflation inlet of the inflatable annular seal;

a pressure relief operable to direct flow from the discharge to the inflation line, the pressure relief operable to open the discharge to direct flow to a surface in a well when a predetermined fluid pressure is reached; and a sub including a first component releasably coupled to a second component such that the sub is configured to disconnect the inflation line between the discharge and the inflation inlet to release pressure in the inflatable annular seal when a selected tension is applied to the well pump system.

2. The system of claim 1, wherein the fluid pump comprises an electric submersible pump.

3. The system of claim 1, wherein the first component and the second component are connected to each other longitudinally by at least one shear pin.

4. The system of claim 3, wherein the inflation line is operable to be withdrawn from a receptacle in the inflatable annular seal on relative movement of the well pump system with respect to a deployment cable when the at least one shear pin is severed.

5. The system of claim 3, wherein the at least one shear pin is configured to sever when the selected tension is applied to the well pump system.

6. The system of claim 1, wherein the well pump system is deployable by an electrical cable.

7. The system of claim 1, wherein the pressure relief comprises a burst disk.

8. The system of claim 1, further comprising a cable coupled with the well pump system and configured to transmit an upward force to the well pump system.

9. The system of claim 1, further comprising a check valve in fluid communication with the inflation line.

10. The system of claim 9, wherein the check valve is configured to maintain a fluid pressure in the inflatable annular seal.

11. A method for deploying a well pump in a well, the method comprising:

moving the well pump to a chosen depth in the well;

starting the well pump to discharge fluid into an inflatable annular seal external to the well pump to inflate the annular seal;

opening a pressure relief to divert discharge of the well pump to the well on one side of the annular seal when the annular seal is inflated;

operating the well pump to move fluid from the well to a surface;

stopping the well pump and applying tension to the well pump to disconnect an inflation line between the well pump and the annular seal and vent fluid trapped in the annular seal; and lifting the well pump out of the well.

12. The method of claim 11, wherein moving the well pump to a chosen depth in the well comprises extending an electrical cable into the well.

13. The method of claim 12, wherein applying tension to the well pump comprises retracting the electrical cable.

14. The method of claim 13, wherein applying tension to the well pump to disconnect the inflation line between the well pump and the annular seal and vent the trapped fluid comprises breaking a shear pin to move a part of the well pump relative to the annular seal.

15. The method of claim 12, wherein lifting the well pump comprises retracting the electrical cable.

16. The method of claim 11, wherein opening the pressure relief to divert the discharge of the well pump to the well comprises operating the well pump to increase a fluid pressure to at least an operating pressure of the pressure relief.

* * * * *